United States Patent [19]

Itani et al.

[11] 4,084,528

[45] Apr. 18, 1978

[54] WORKING METHOD OF BREAKING UP SHIP

[75] Inventors: Mituo Itani, Chiba; Hiroyuki Kawashima, Yokohama; Takasuke Inoue, Kunitachi; Mikio Maruyama, Tokyo, all of Japan

[73] Assignee: Mitsui Engineering & Shipbuilding Co., Ltd., Tokyo, Japan

[21] Appl. No.: 757,292

[22] Filed: Jan. 6, 1977

[30] Foreign Application Priority Data

| | | |
|---|---|---|
| Mar. 18, 1976 | Japan | 51-29607 |
| Mar. 18, 1976 | Japan | 51-29613 |
| Mar. 18, 1976 | Japan | 51-29615 |
| Mar. 18, 1976 | Japan | 51-29617 |

[51] Int. Cl.[2] ..... B63C 1/06

[52] U.S. Cl. ..... 114/45; 114/65 R

[58] Field of Search ..... 114/45, 46, 44, 77 R, 114/79 R, 270, 264, 268, 65 R, 26, 230; 29/403, 426

[56] References Cited

U.S. PATENT DOCUMENTS

| | | | |
|---|---|---|---|
| 3,300,187 | 1/1967 | Saxe et al. | 114/230 |
| 3,680,512 | 8/1972 | Yamura | 114/77 R |
| 3,919,960 | 11/1975 | Amoss | 114/77 R |
| 3,962,981 | 6/1976 | O'Kon et al. | 114/264 |

*Primary Examiner*—Trygve M. Blix
*Assistant Examiner*—Jesus D. Sotelo
*Attorney, Agent, or Firm*—Armstrong, Nikaido, Marmelstein & Kubovcik

[57] ABSTRACT

The present invention relates to a working method of breaking up a ship, particularly a large ship, and is characterized by cutting the hull to shorten the length thereof as it is floating on the sea, and more particularly characterized by, on the cutting of the hull, inserting a buoyancy body under the stem portion or the stern portion to trim the hull and floating up said portion and locating there a marine workshop, drawing the hull into the marine workshop while performing breaking up the hull. According to the present invention, it is possible to break up a hull without special harbor facilities and even at locations such as the lee of island and other position where there is no harbor facilities. Also, since the hull is drawn in the marine workshop and broken up to shorten the length of the hull, the working is greatly simplified compared with a prior method wherein the hull is broken up to shorten the height thereof, and as a result the working period can be shortened.

5 Claims, 19 Drawing Figures

WORKING METHOD OF BREAKING UP SHIP

BACKGROUND OF THE INVENTION

As is well known, high grade metal materials are used in a hull in large quantities, and when it becomes a scrapped vessel, it is broken up into pieces of metal materials (bar materials, plate materials and shape steels) to make articles of commerce or scrapped materials for sale.

As a prior method of breaking up a hull, the portion of a hull floating on the sea which is above the water surface is cut into large masses (generally called as large separation), these masses are lifted by means of a marine crane or a land overhang crane and disposed on the land and then cut into small masses (generally call as small separation). After the end of the breaking-up of the portion appearing above the water surface, the portion below the water surface is towed onto shallows, and waiting the ebb-tide the hull appearing above the water surface is subjected to said large separation in the same manner as described above and then to said small separation.

In the case of said prior art breaking-up method, it is required to have a position to moor the hull, shallows, a quay to land the broken-up bodies and a wide place where the small separation is carried out, and it is impossible to perform the breaking-up operation everywhere. As another problem, the large separation and the small separation are carried out at different positions separated from each other, so that the transportation by a crane is required, and thereby the working number required for said transportation amounts to as large as 30% of the whole working number of the breaking-up. In addition, there is a further problem in which many workmen are required because the breaking-up working places are separated into a plurality of positions.

Under such circumstances, in the prior art working method, there are a severe restriction in the breaking-up place as well as a requirement of many workmen, so that scraps and metal materials which can be used immediately become inevitably expensive.

OBJECT OF INVENTION

An object of the present invention is to remove said drawbacks of the prior art method, namely to provide a working method which has no requirement of harbour facilities, almost no restriction of place and nevertheless can break up a hull efficiently.

A further object of the present invention is to provide a working method of breaking up a hull wherein the breaking-up operation is relatively easy and can shorten the working period.

DETAILED EXPLANATION OF INVENTION

The present invention is characterized by, in order to attain the above objects, floating the stem portion or the stern portion of a hull above the water surface, locating a marine workshop at the position where said portion of the hull has floated, and breaking up the hull so as to shorten the length thereof in said marine workshop, namely characterized by progressively embracing the hull into the marine workshop and breaking up from the portion of the hull embraced in the workshop progressively.

Next, the present invention will be described with respect to its embodiments.

Figure 1:
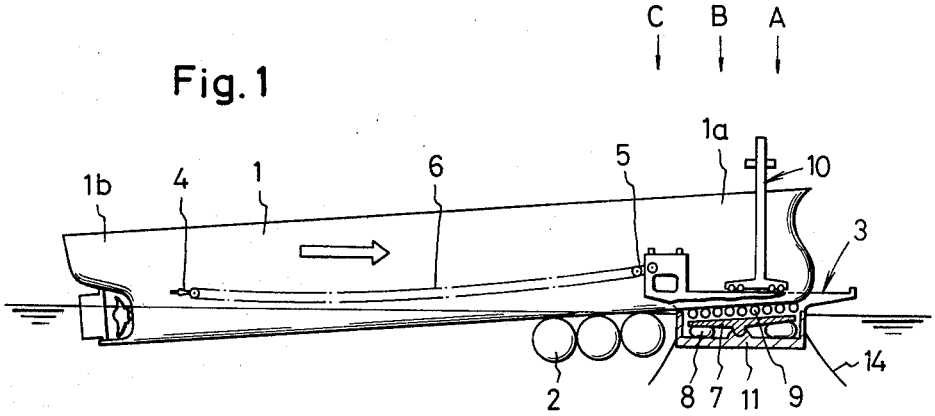
FIG. 1 is a view showing the condition where the stem portion is floated by means of a buoyancy body and a marine workshop is located at that position.

First, a hull to be broken up is moored on the sea at a suitable point, and the breaking-up working is started and, on the other hand, for example, a buoyancy body 2 is inserted under the stem portion 1*a* to float it up as shown in FIG. 1. A marine workshop 3 is then located below the stem portion 1*a* and using this marine workshop 3, the breaking-up operation proceeds. In this operation, the prior art fusion cutting method is mainly used. This breaking-up operation proceeds on the marine workshop 3 until products or scrap materials are obtained, however, in this case it is preferable to perform both the large separation and the small separation or directly the small separation and thereafter progress the product working by the use of a press or cutter in the workshop.

The breaking-up operation is performed in the order shown by the arrow directing from the stem to the stern A→B→C. Namely this operation is performed in such manner that in the longitudinal direction of the hull (or in the direction in which the hull is shortened) the breaking-up is progressed, which is different from the prior art horizontal breaking-up above exemplified in which the breaking-up progresses from the floated-up portion toward the submerged portion.

Figure 2:
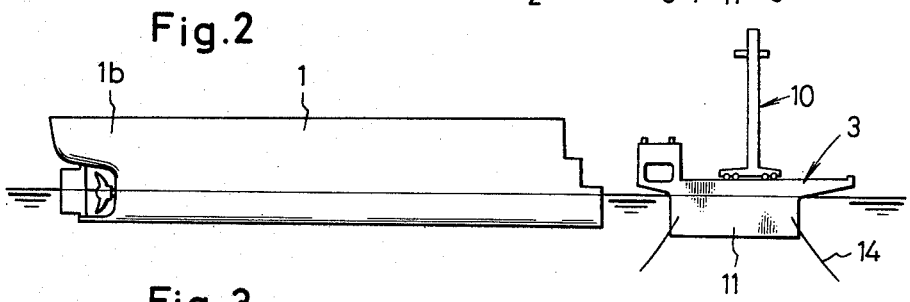
FIG. 2 is a view showing the condition where the stem portion has been broken up.

FIG. 2 shows the condition where the first stage breaking-up has been completed, in which the marine workshop 3 is disengaged from the hull 1 and the buoyancy body 2 located under the hull 1 has been removed.

Figure 3:
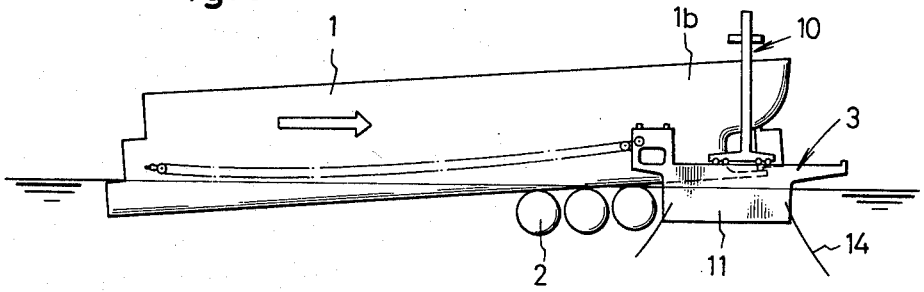
FIG. 3 is a view showing the condition where the stern portion of the hull is floated up by means of a buoyancy body and a marine workshop is located at that position.

Next, the hull 1 is reversed in its forward and rearward positions as shown in FIG. 3, and the buoyancy body 2 is inserted on the side of the stern 1*b* to float the stern 1*b* up and the marine workshop 3 is inserted below the stern 1*b* and thus the breaking-up operation is progressed in the same manner as described above. With the progress of the breaking-up operation, the marine workshop must be displaced, and as a method therefor, for example, a pulley 4 is mounted on the side of the hull 1 as shown in FIG. 1, and a cable or wire 6 is stretched between it and a winch 5 so as to permit a relative movement between the hull 1 and the marine workshop 3.

Since said marine workshop 3 bears a part of the load of the hull 1, it is provided with a special load supporting device. 7 is a support plate, which has a pneumatic cushion 8 at the lower part and long carrier rollers 9 at the upper part thereof thereby receiving the load of the hull 1 in dispersion condition and making the marine workshop 3 easy to move relative to the hull 1. The marine workshop 3 forms a kind of barge of U-shape having vertical walls on both sides when viewing from the front, and has a breaking-up device including cranes etc. mounted on the both sides and also a power source and a set of devices necessary for the working.

Figure 4:
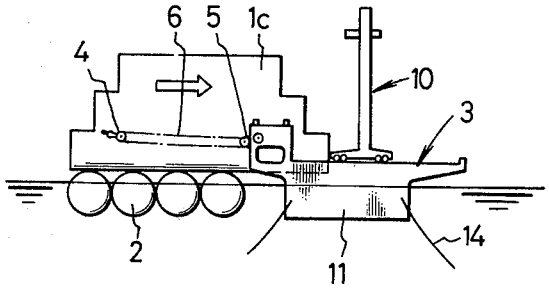
FIG. 4 is a view showing the working condition while the final portion is being broken up.

FIG. 4 shows a condition in which the breaking-up operation has further progressed, and in this case the hull 1*c* is broken up in the longitudinal direction and is drawn toward the marine workshop 3 and therein as shown by the arrow while it is broken up one after another, and according to this invention, a hull to be broken up is floated on the sea and the whole breaking-up operation can be carried out on the sea.

In the present invention, the hull 1 is inclined by the use of buoyancy bodies 2 as shown in FIG. 1 or FIG. 3 thereby floating the stem or the stern up, and a marine workshop 3 is located at the floated portion, and the hull is moved relatively so as to be drawn in the marine workshop 3 while the breaking-up operation is proceeded, and therefore it has the following effects.

A. Since the hull to be broken up is floated on the sea and it is subjected to the breaking-up operation as it is, there is almost no limitation for the place. Particularly in the case of a place other than the harbor, the breaking-up operation can be performed under the lee of an island.

B. Since the hull 1 can be drawn in the marine workshop 3 by the use of a winch or rollers as in the above described embodiment, the breaking-up operation can be very smoothly carried out. Particularly in a working method in which the hull 1 is inclined, there is a characteristic that the marine workshop 3 is easy to be inserted under the hull 1 and it is also possible to obtain a buoyancy required for the inclination of the hull by means of both the buoyancy body 2 and the marine workshop 3.

C. In the prior art working method, the masses produced by the large separation are transported by means of a crane, so that many operations are required therefor, but according to the present invention, such operations can be largely omitted.

D. In addition, in the present invention, since the hull is longitudinally cut off so as to gradually shorten the length of the hull, the relative movement between the marine workshop and the hull ends only at one time, and therefore in this sense, the operation time can be largely shortened.

As apparatus for carrying out a working method of breaking up a hull, various kinds of apparatuses have been developed hitherto, and now these will be explained individually.

Marine Workshop

Figure 5:
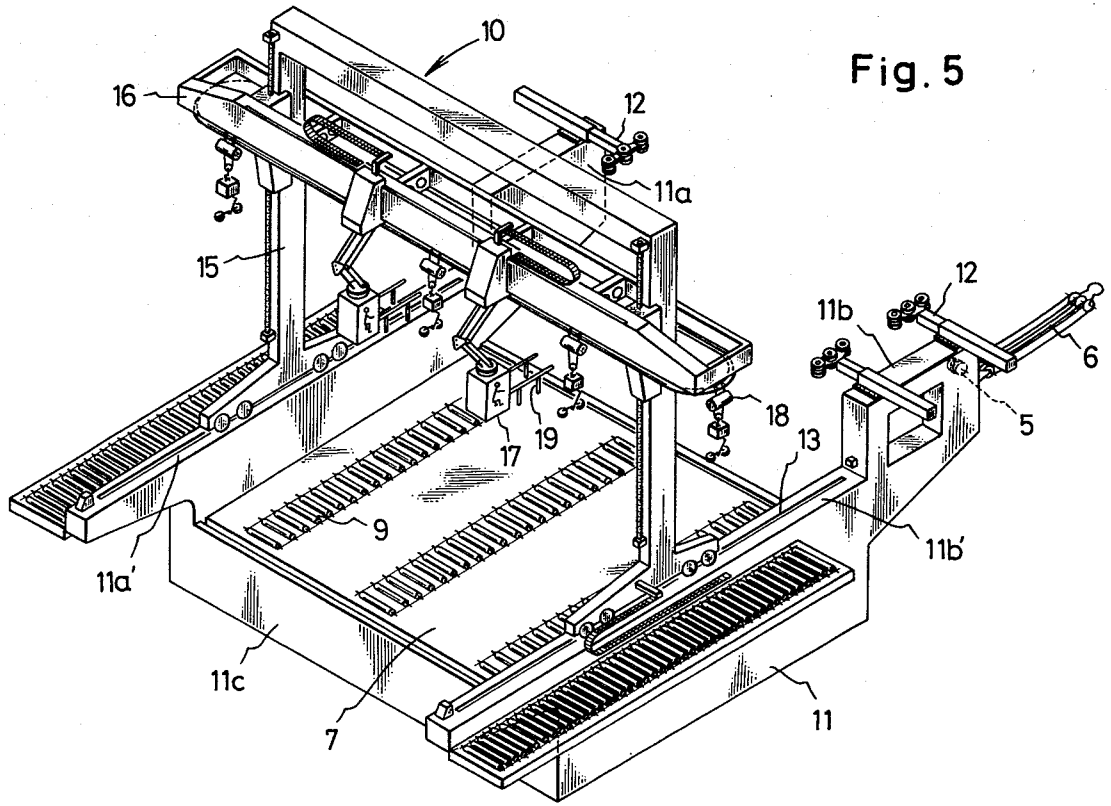
FIG. 5 is a perspective view of a marine workshop.
Figure 6:
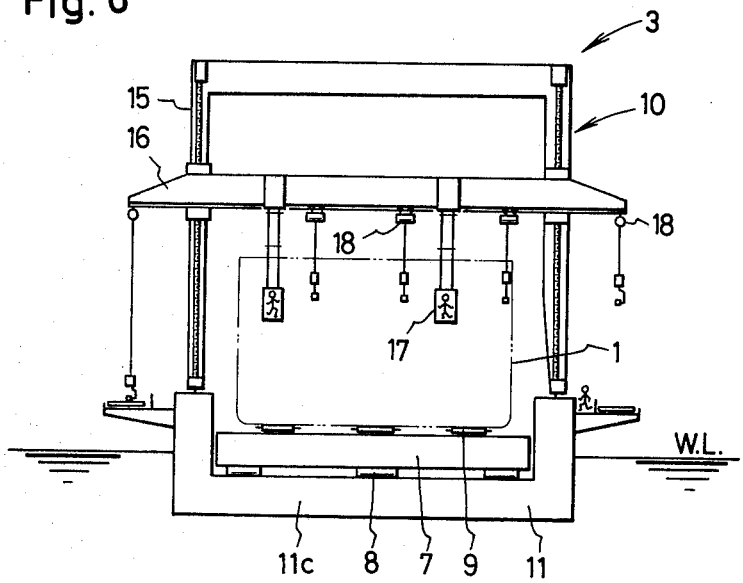
FIG. 6 is a front view of said workshop.
Figure 7:
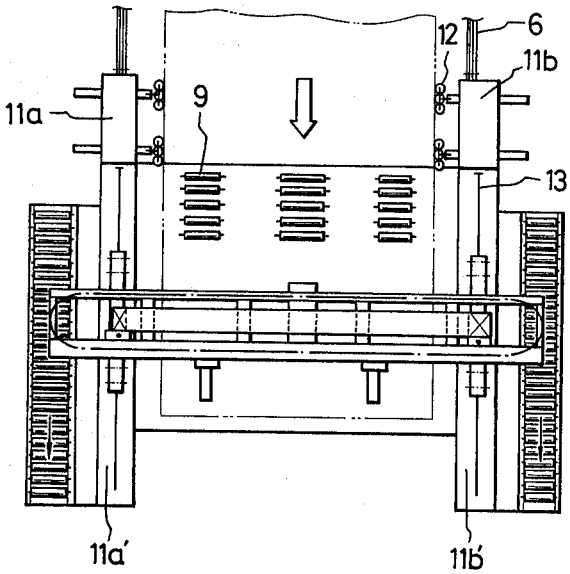
FIG. 7 is a plan view of said workshop.

In FIGS. 5,6 and 7, a marine workshop 3 is provided with various kinds of devices such as described below on a barge 11 composing a body of the workshop. The barge 11 resembles a floating dock and its floating and sinking are carried out by charging and discharging of water in and out of the tank of the barge and has a U-shape when viewing from the front thereof and the vertical portions 11*a* and 11*b* on both sides thereof exist at the broadsides of the hull and its horizontal portion 1*c* exists at the ship bottom, and a broadside pressing device 12 and a winch 5 (transporting-in device) are provided on the vertical portions 11*a* and 11*b* of the barge 11. Also on the vertical portions 11*a*′ and 11*b*′ which are lower by one step than said portions provided with said winch etc. thereon rails 13 are provided, and a breaking-up device 10 is movable thereon along the longitudinal direction of the hull.

On the horizontal portion 11*c* of the barge 11 air springs 8 are provided, and above said air spring a barge load receiving stand (floating support plate 7) is provided, and on said stand carrier rollers 9 are arranged, and by using these devices the bottom of the hull is supported.

An anchor rope 14 is provided on the barge 11 to prevent the movement of the marine workshop during the breaking-up operation.

Buoyancy bodies 2 are deflated before the use, and they are attached at the ship bottom and then inflated by feeding air therein thereby floating up the hull by their buoyancy.

The broadside pressing device 12 has a rotary body such as rubber roller etc. attached at its forward end, said rotary body being mounted on a telescoping arm. On the support plate 7 the carrier rollers 9 are disposed to facilitate the relative movement between the hull 1 and the marine workshop and a face pressure is applied to the horizontal portion 11*c* of the barge 11 by means of the air cushions 8 mounted below the support plate 7 to receive a large load on the plate.

Upon breaking up the hull 1 by the use of said marine workshop 3, the buoyancy bodies 2 are attached at the bottom of the stem of the hull 1 (or at bottom of the stern) thereby floating the one side of the hull 1, and then the barge 11 is engaged to the ship bottom and the barge 11 is located under the ship bottom by means of a wire 6 stretched between the pulley 4 and the winch 5 and the buoyancy of the barge 11 is increased, as desired, so as to surely support a part of the hull 1.

On both sides of the barge 11 rails 13 are provided in the longitudinal direction of the hull, and the breaking-up device 10 runs on said rails. The breaking-up device comprises a frame body 15, a frame body 16 movable up and down on the pole portions of said frame body 15, and a gondola 17 and a hoist 18 attached to said frame body 16, etc., and an operator on the gondola 17 can operate a cutter 19 to perform three-dimensional breaking-up working. If the hoist 18 is provided with a magnetic chuck, the gripping, releasing and transporting of broken-up pieces can be easily carried out.

Hull broadside supporting device

In the case of breaking up the hull, it is important to surely guide the hull to a given position of the barge. In the case where the hull rocks or deviates to one side in the barge, the hull becomes very unstable, resulting in giving undesirable damages to the hull or occurrence of troubles during the breaking-up operation.

Figure 8:
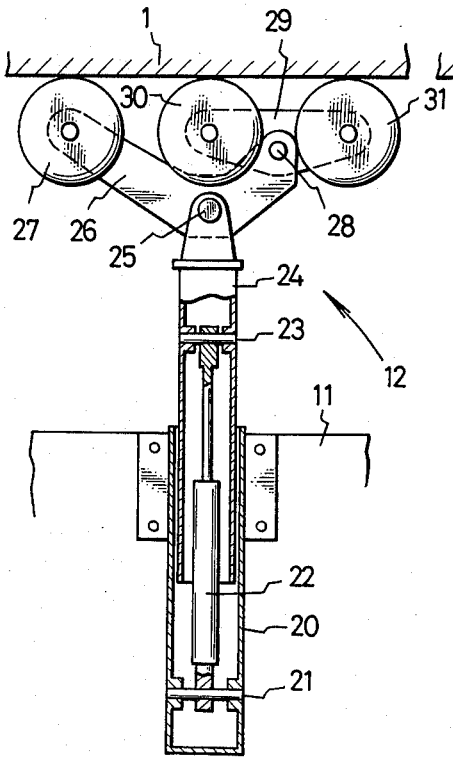
FIG. 8 is a front sectional view of a broadside supporting device.
Figure 9:
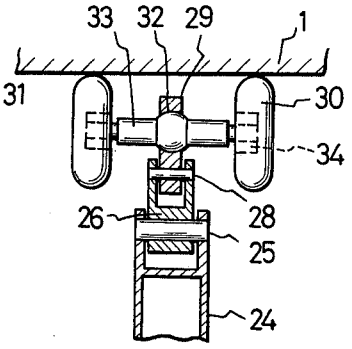
FIG. 9 is a side sectional view of the main part of said broadside supporting device.

A broadside supporting device used in the present invention has a construction as shown in FIGS. 8 and 9. The broadside supporting device 12 is mounted in a frame 20 attached to the barge 11 by means of a pin 21 for telescopic movement through an oil pressure cylinder 22. At the rod of said cylinder 22 a telescopic frame 24 is mounted by means of a pin 23, and at the forward end of said telescopic frame 24 a ∧-shaped beam 26 is attached for rocking motion by means of a pin 25 and on one end of said beam 26 a pneumatic wheel 27 is provided and on the other end a beam 29 is mounted for rocking motion through a pin 28, and pneumatic wheels 30, 31 are mounted on both sides of said beam 29 respectively.

As is apparent from the drawings, since the beams 26 and 29 are respectively supported for rocking motion, these beams rock after the hull 1 to which said beams contact, and thus the force is distributed to the separate pneumatic wheels 27, 29 and 31 respectively, and the total force thereof is applied to the oil pressure cylinder 22 through the telescopic frame 24.

The pneumatic wheels 30, 31 are supported at both ends of a spherical shaft 33 supported by means of a spherical bearing 32 provided in the beam 29 through bearings 34.

Also, the pneumatic wheel 27 is supported by means of the similar construction, and after all, the pneumatic wheels 27, 30 and 31 are moved back and forth after the surface contour of the hull 1.

As shown in FIGS. 6 and 7, the ship bottom is supported by the carrier rollers 9 provided on the barge 11 moored by means of anchor rope 14, and the both broadsides are supported by means of the broadside supporting devices 12 and thereby the relative positional relation between the hull 1 and the barge 11. The pressure oil cylinder 22 is applied with a controlled oil pressure so that the telescopic frames 24 move back and forth after the contour of the broadside of the hull 1.

The broadside supporting device 12 according to the present invention supports the beam for rocking motion with respect to the telescopic frame, and the wheels are rotatably supported on the pins supported for rocking motion with respect to said beam and the telescopic frame having the wheels mounted thereon is telescopically mounted on the barge through the oil pressure cylinder, and therefore the present invention of such construction provides the following effects.

The broadside supporting devices 12 are arranged with respect to the barge 11 so as to support the broadsides from the both sides, so that the hull 1 is guided in a given position of the barge 11, namely in the central portion thereof.

As the breaking-up operation of the hull 1 proceeds, the hull 1 is drawn into the barge 11 as shown in FIGS. 1, 3 and 4, and in this case the broadsides are supported by means of the broadside supporting devices 2, and therefore the hull 1 can be correctly guided.

The broadside supporting device 12 is telescope toward the broadside by means of the oil pressure cylinder 22 and the wheels 27, 30 and 31 supported by the beams 26 and 29 move after the surface contour of the broadside, and accordingly it is possible to apply equally distributed load to the broadside thereby preventing the occurrance of a local stress in the broadside and the application of destructive force to various parts of the broadside supporting device.

Figure 10:
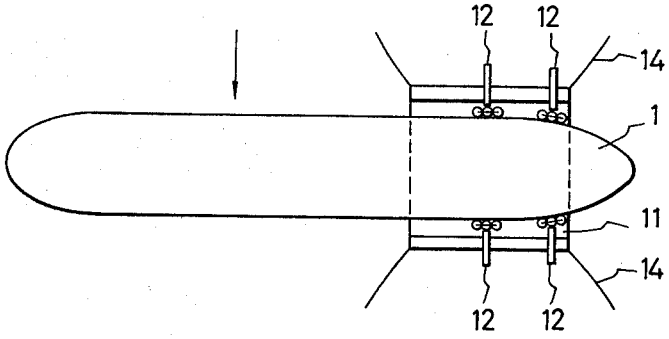
FIG. 10 is a plan view showing the condition where the broadside is being supported by means of said supporting device.

Also, as shown in FIG. 10, the hull 1 tends to cause a movement different from that of the barge 11 when applied with a wind pressure, however in such a case the relative positions of the both are held, so that they move as a unit and therefore there is no occurrance of hindrance to operations such as breaking-up working and so on.

Hull Supporting Device

In order to carry out the breaking-up of a hull in saftey, it is necessary to securely support the hull on the barge composing the main part of the marine workshop.

As described above, between the broadsides of the hull and the barge there is a supporting relation by means of the broadside supporting devices having wheels, but there is a problem that the hull and the barge can not be united if the ship bottom can not be supported without allowing the relative movement between the hull and the barge.

The hull supporting device of the present invention has the function described above and is characterized by comprising a barge, a rocking body mounted thereon and a pneumatic type cushion mounted between said barge and the rocking body.

Figure 11:
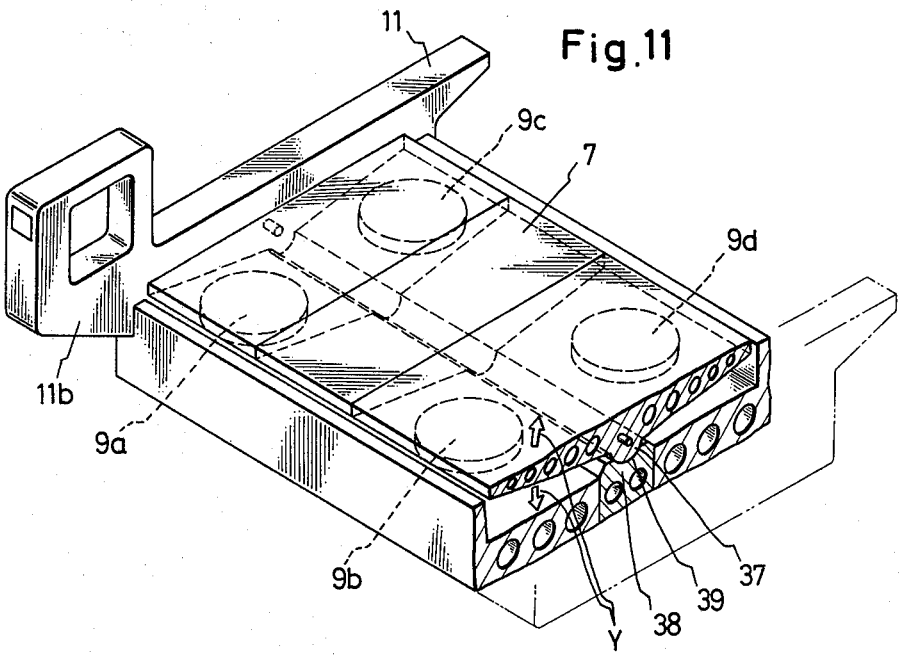
FIG. 11 is a perspective view of a hull supporting device.

FIG. 11 is a perspective view showing the hull supporting device, and at the body portion of the barge 11 of U-shape when viewed in the forth and back direction a support plate 7 is mounted through pneumatic cushions *9a, 9b, 9c* and *9d* and this support plate is constructed so as to rock in the direction shown by the arrow Y.

The support plate 7 is normally supported by means of the pneumatic cushions *9a, 9b, 9c* and *9d*, but in the case a larger load is applied thereto, a semicylindrical projection 37 formed at the central lower face of the support plate 7 comes to contact with a supporting portion 38 formed in the body portion of the barge 11 and thereby to bear a part of said load. In addition, between said projection 37 and the supporting portion 38 there is provided a bearing material 39 of, for example, hard rubber or synthetic resin so that a large load can be received in the distributed condition.

Figure 12:
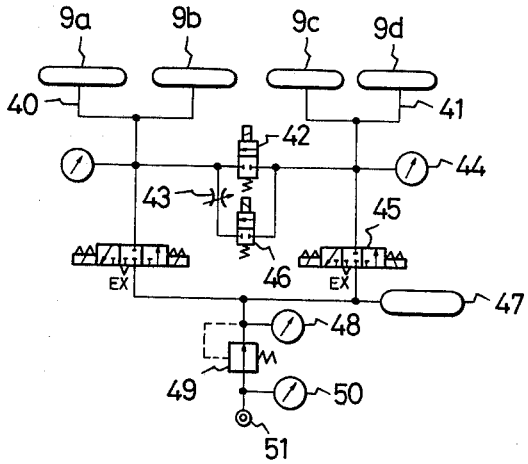
FIG. 12 is a view showing a pressure controlling circuit for a cushion for the hull supporting device.

FIG. 12 shows a pressure controlling circuit of the cushion, wherein the cushions *9a* and *9b* and the cushions *9c* and *9d* are respectively communicated by means of respective pipings 40 and 41 with each other, and between both said pipings there is a communication via a communication valve 42. 43 is a throttle valve, 46 is a reduction communication valve, 44 is a load gauge, 45 is a change-over valve, 47 is a reserve tank, 48 is a pressure gauge, 49 is a reducing valve, 50 is a main pressure gauge and 51 is a compressed air source.

In the above device, in the normal condition, the cushions *9a, 9b* and the cushions *9c, 9d* are communicated with each other through the throttle valve 43 and the reduction communication valve 46, but in case an abrupt pressure is applied onto the support plate 7, the communication valve 42 operates to bring the pipings 40 and 41 into the communication condition and thereby the positions of the barge 11 and the support plate 7, namely the positions of the barge 11 and the hull can be adjusted.

According to the hull supporting device of the present invention, the hull 1 is supported on the support plate 7 and this support plate 7 is supported for rocking motion on the barge 11 through the cushions *9a, 9b, 9c, 9d* . . . . , and as a result the barge 11 supports the hull correctly and safely. Accordingly when the marine workshop having such a construction is utilized, it is possible to break up or repair a hull safely and efficiently. The number of the cushion may be determined in accordance with a load to be supported.

Winch

As means for drawing the hull into the barge of the marine workshop, a wire rope and a winch are used, and for said purpose, it is required such one that has a construction which generates a strong tractive force.

The prior art drum type winch has such problems that in the case of using a long rope in the multiple winding condition, the rope suffers a damage due to confused winding of the rope and the rope is also easy to slip relative to the drum, and accordingly it is difficult to transmit a larger load, and also it has much danger and thus the device has a tendency to become larger in size thereof.

The winch used in the present invention has been obtained to remove said drawbacks and is characterized in that the rope is wound to the drum in one row and also this rope is positively pressed against the drum face.

Figure 13:
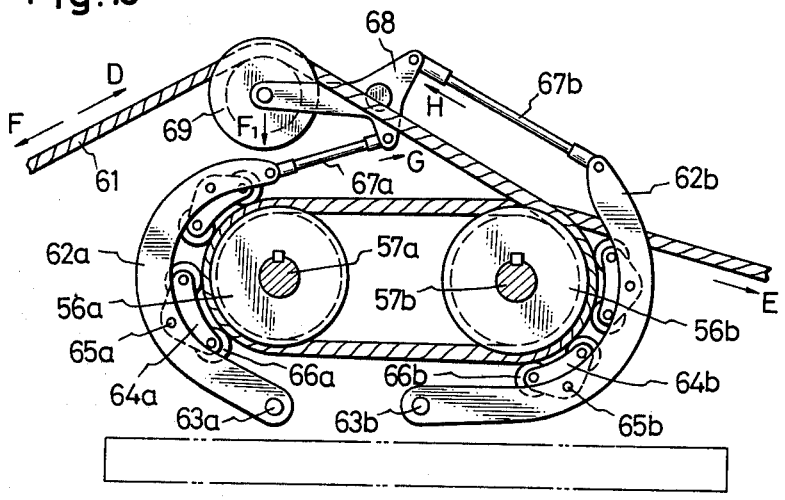
FIG. 13 is a front view of a winch.
Figure 14:
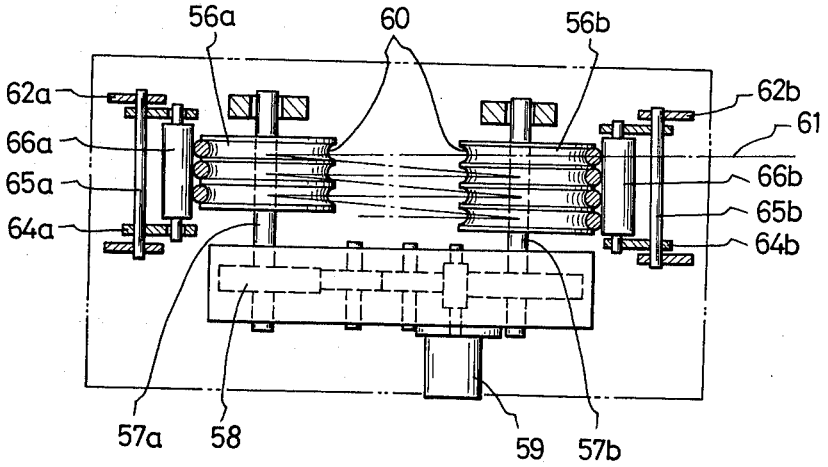
FIG. 14 is a plan view of said winch.

FIG. 13 is a side view of a winch which has been particularly developed for carrying out the present invention, and FIG. 14 is a partly broken sectional plan view.

Drums 56*a* and 56*b* are rotatably supported at a certain interval, and between the shafts 57*a* and 57*b* of both the drums, a gearing device 58 is mounted and operative by a force from a power source such as oil pressure motor 59 etc. Said drums have guide grooves 60 formed thereon and the rope 61 is guided thereby.

Explaining the characteristic construction of said winch, bent arms 62*a* and 62*b* are supported for rocking motion on shafts 63*a* and 63*b* with respect to the drums 56*a* and 56*b*, and on these arms frames 64*a* and 64*b* are supported for rocking motion on shafts 65*a* and 65*b* and also each of said frames 64*a* and 64*b* has two rollers 66*a*, 66*b*.

The end portions of said arms 62*a*, 62*b* are connected through connecting rods 67*a*, 67*b* to a rocking lever 68, which is provided with a grooved roller 69.

Next, the operation of said winch will be explained.

When the oil pressure motor 59 is driven, the rope 61 is introduced in the arrow direction D, and wound around the drums 56*a*, 56*b* a plurality times and then led out in the arrow direction E. In this case, the rope 61 is subject to a tension F, and its component of force F, acts on the rocking lever 68 thereby rotating it counterclockwise. Due to this rocking motion of this rocking lever 68, the connecting rods 67*a*, 67*b* are pulled respectively in the directions of the arrows G, H and subsequently the bent arms 62*a*, 62*b* are moved around fulcra of the shafts 63*a*, 63*b* so as to embrace the drums 56*a*, 56*b* each other and as a result the rollers 66*a*, 66*b* mounted for rocking motion on said arms press the rope 61 against the surfaces of the drums 56*a*, 56*b*.

After all, the force pressing the rope 61 against the surfaces of the drums 56*a*, 56*b* relates to the tension acting on the rope 61, and with increasing the tension, the force pressing the rope 61 against the drums 56*a*, 56*b* also increases accordingly, thereby permitting prevention of the slip of the rope.

It is a matter of course that the force acting on the rollers 66*a*, 66*b* is proportional to the force acting on the rope 61, and also it relates to the arm length of the rocking lever 68, and accordingly it is preferable to determine the dimensional relation of said members in consideration of a desired pressing force.

Figure 15:
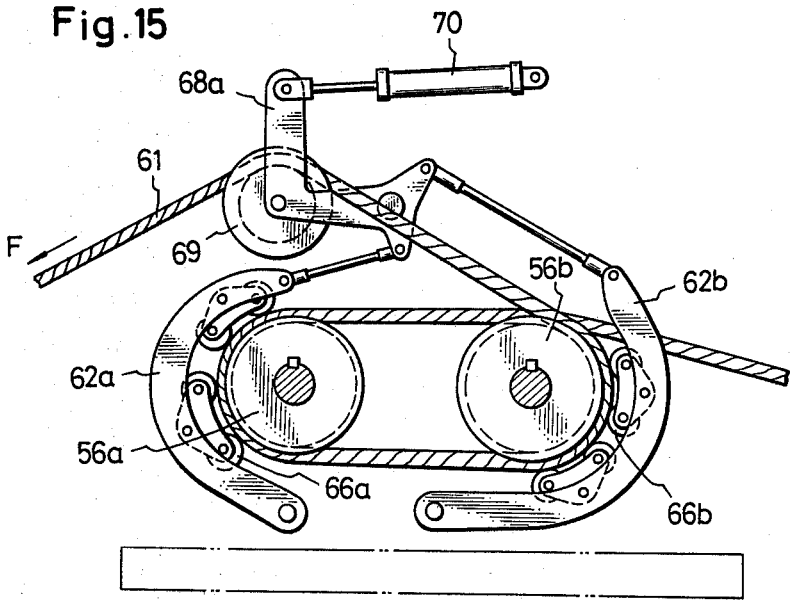
FIG. 15 is a front view of another winch construction.

There may be such a case that it is impossible to obtain a sufficient pressing force to prevent the slip of the rope only by the tension acting on the rope 61, but in such a case it is preferable to allow the rocking lever 68*a* to be applied with the force of the oil pressure cylinder 70 as shown in the embodiment in FIG. 15. In one case, the oil pressure cylinder 70 is applied with a specific oil pressure or pneumatic pressure, and in the other case the pressure applied to said cylinder is changed in response to a sensed tension of the rope 61.

The winch of the above described construction have the bent arms 62*a*, 62*b* on the sides of the drums 56*a*, 56*b*, and these arms are provided with the rollers 66*a*, 66*b*, and these bent arms 62*a*, 62*b* are rocked by utilizing the movement of the rocking arms 68, 68*a* rocking by the force of the rope 61 thereby pressing the rope 61 against the guide grooves of the drums 56*a*, 56*b*, with the result that the slip of the rope 61 is completely prevented.

Also, since the drums 56*a*, 56*b* are wounded by the rope 61 only once without confused winding thereround, the rope 61 is prevented from damage thereof to the utmost and thereby a device rich in safety can be obtained.

Weight Object Supporting Roller

Weight of a hull is very large, so that it requires very difficult operations to put the hull on the support plate mounted for rocking motion on the barge. In order to carry out such operations smoothly, it is necessary to provide rollers on the support plate and support the hull thereon, but there is a problem that usual rollers can not support the hull.

In the present invention, there are used rollers which have simple construction, nevertheless can support a weighty object. Next, these will be explained.

The prior art rollers are impossible to use to support a weighty object and also complicated in construction and have many troubles. The present invention provides rollers which remove said drawbacks of such kind of rollers.

Hereinafter, an embodiment of such roller will be explained with reference to the drawings.

Figure 16:
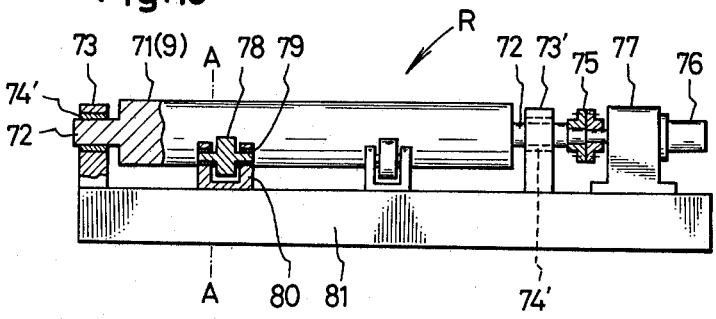
FIG. 16 is a partly broken sectional view of rollers for supporting a weight object.

FIG. 16 is a partly broken sectional side view showing the main portion of a weight object supporting roller according to the present invention, wherein shaft portions 72, 72' mounted at both ends of a main roller 71 are supported by bushing 74, 74' mounted in bearing boxes 73, 73', and the shaft portion 72' is connected with the shaft of a reduction gear device 77 driven by an oil pressure motor 76 through a coupling 75 and the main roller 71 is driven by the oil pressure motor 76 as desired.

Figure 17:
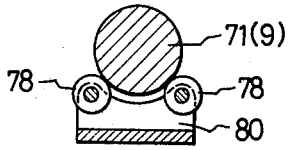
FIG. 17 is a cross-sectional view taken along lines A—A of FIG. 16.

In the intermediate portion of the main roller 71, there are provided an auxiliary roller 78, a bushing 79 and a bearing bracket 80, thereby bearing the load of the main roller 71 in distributed condition. FIG. 17 is a cross-sectional view taken along lines A—A of FIG. 16, and as is obvious from this figure, the main roller 71 is supported by means of two auxiliary rollers 78 in the section of A—A.

Figure 18:
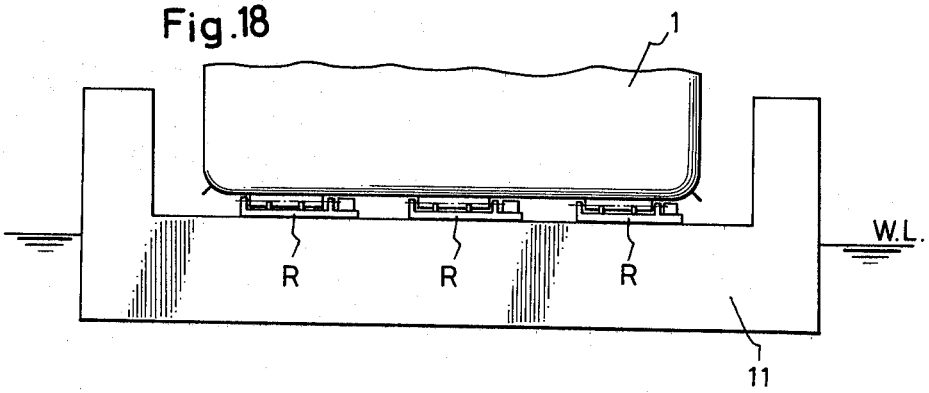
FIG. 18 is a cross-sectional view showing the condition where the hull is supported in the marine workshop.

Said each member is supported on a stand 81, and the weight supporting roller C (carrier conveyor) assembled in said condition is fixed on the barge as shown in FIG. 18.

Figure 19:
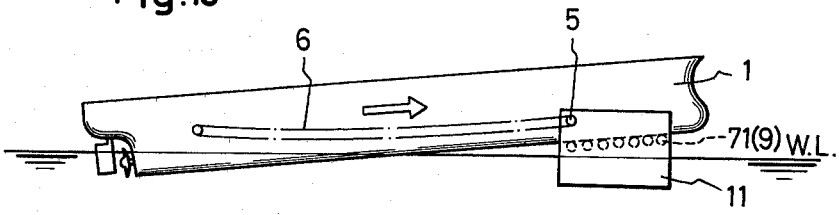
FIG. 19 is a side view showing the condition where the stem portion is supported in the marine workshop.

Explaining a using example of said weight object supporting roller, as shown in FIG. 19, the buoyancy body is attached near the stem (or near the stern) of the hull 1 thereby inclining the hull 1 to allow the stem to come out above the water surface. Said barge 11 is then located under the stem and the hull 1 is drawn into the barge 11 by pulling the wire 6 attached to the hull 1 as shown by the arrow by means of a winch 5 mounted on the barge 11. In this case, the hull 1 is supported by the main rollers 71 shown in FIG. 16, and the oil pressure motor 76 is driven as desired, so that the hull can move smoothly. In this case, it is not always necessary to drive the whole main rollers 71, but is preferable to drive a necessary number of the main rollers for generating an auxiliary force at the time of drawing the hull 1 into the barge 11.

Auxiliary roller 78 is provided for reducing the flextion of the main roller 71 and bearing a large load, and the main rollers 71 are preferably arranged at positions distributing the main rollers 71 with equal intervals so as to disperse the load.

Said weight object supporting roller is provided with long main rollers 71 and auxiliary rollers 78 for the support at the intermediate positions of said main rollers and thus the load of the main rollers 71 is dispersed and borne by means of the auxiliary rollers 78, and accordingly a large load can be borne by the main rollers 71 and these main rollers can be prevented from occurrance of damage.

What is claimed is:

1. A method of breaking up a ship hull said method comprising supporting a portion of said hull with bouyant means such that the stem or stern of the hull is above the water surface the other portions of the hull remaining in the water; positioning the portion of the stem or stern above the water surface within a marine workshop; breaking up said portion of the hull positioned within the marine workshop; and drawing an additional portion of the hull into the marine workshop after said portion of the hull in the marine workshop has been broken up.

2. A method of breaking up a hull as claimed in claim 1, wherein the marine workshop is composed of a barge, a support plate supported for rocking motion with respect to said barge and a pneumatic cushion interposed between said support plate and the barge and the pressure of said pneumatic cushion is adjusted to stably support the hull within the marine workshop while the hull is broken up within the marine workshop.

3. A method of breaking up a hull as set forth in claim 1 wherein supporting a portion of said hull with said buoyant means comprises mounting a buoyant body under said portion of said hull, and wherein drawing an additional portion of the hull into said marine workshop includes connecting a cable between said hull and said marine workshop and pulling said cable into said marine workshop to thereby draw said hull into said marine workshop.

4. A method of breaking up a hull as claimed in clam 3, wherein said marine workshop includes a barge, a support plate supported for rocking motion with respect to the barge, a pneumatic cushion interposed between said support plate and the barge and a winch arranged to sense a tension applied to the cable and press said cable against winding drums, and wherein the ship bottom is supported by said support plate such that air supply to the pneumatic cushion is adjusted in response to the relative position between the hull and the barge so as to stably support the hull on the support plate, and the winch draws the hull into the marine workshiop, where the hull is broken up.

5. A method of breaking up a hull as claimed in claim 3, wherein said marine workshop includes a barge, a support plate supported for rocking motion with respect to the barge, a pneumatic cushion interposed between said support plate and the barge, a winch arranged to sense a tension applied to the cable and press said cable against winding drums and a weighted object supporting roller mounted on said support plate, said weighted object supporting roller comprising long main rollers supporting the ship bottom and short auxiliary rollers supporting the intermediate of each of said long main rollers, wherein the ship bottom is supported by means of said weighted object supporting rollers and said winch draws the hull into the marine workshop, where the hull is broken up.

* * * * *